US010961025B2

(12) United States Patent
Ono

(10) Patent No.: US 10,961,025 B2
(45) Date of Patent: Mar. 30, 2021

(54) POURING SPOUT OF CONTAINER

(71) Applicant: FUJIMORI KOGYO CO., LTD., Shinjuku-ku (JP)

(72) Inventor: Matsutaro Ono, Shinjuku-ku (JP)

(73) Assignee: FUJIMORI KOGYO CO., LTD., Shinjuku-ku (JP)

( * ) Notice: Subject to any disclaimer, the term of this patent is extended or adjusted under 35 U.S.C. 154(b) by 0 days.

(21) Appl. No.: 16/466,933

(22) PCT Filed: Dec. 7, 2017

(86) PCT No.: PCT/JP2017/043944
§ 371 (c)(1),
(2) Date: Jun. 5, 2019

(87) PCT Pub. No.: WO2018/105686
PCT Pub. Date: Jun. 14, 2018

(65) Prior Publication Data

US 2020/0062463 A1 Feb. 27, 2020

(30) Foreign Application Priority Data

Dec. 8, 2016 (JP) ..... JP2016-238187

(51) Int. Cl.
*B65D 47/08* (2006.01)
*B65D 75/58* (2006.01)

(52) U.S. Cl.
CPC ..... *B65D 47/08* (2013.01); *B65D 47/0804* (2013.01); *B65D 75/5872* (2013.01); *B65D 75/5883* (2013.01)

(58) Field of Classification Search
CPC .. B67D 3/0032; B67D 3/0025; B67D 3/0035; B65B 3/06; B01F 15/0205;
(Continued)

(56) References Cited

U.S. PATENT DOCUMENTS 1,241,352 A * 9/1917 Doering ..... B65D 51/2835 222/88
3,347,410 A * 10/1967 Schwartzman .... B65D 51/2835 222/80
(Continued)

FOREIGN PATENT DOCUMENTS

JP 2002-543006 A 12/2002
JP 2003-165560 A 6/2003
(Continued)

OTHER PUBLICATIONS

International Search Report and Written Opinion dated Feb. 27, 2018 in PCT/JP2017/043944 filed Dec. 7, 2017.

*Primary Examiner* — Charles P. Cheyney
*Assistant Examiner* — Randall A Gruby
(74) *Attorney, Agent, or Firm* — Oblon, McClelland, Maier & Neustadt, L.L.P.

(57) ABSTRACT

A pouring spout of a container includes a spout main body and a closing member. The spout main body includes a tubular pouring part, and an attached part attachable to the container on one end side of the tubular pouring part in an axial direction of the tubular pouring part. The closing member closes the one end side of the tubular pouring part, and is fitted onto an inner circumferential surface of the tubular pouring part on the one end side thereof in such a manner that the closing member is capable of being removed from the inner circumferential surface of the tubular pouring part by an external force applied from other end side opposite to the one end side in the axial direction.

19 Claims, 6 Drawing Sheets

(58) Field of Classification Search
CPC ..... B01F 15/0208; B01F 15/0211; B01F 15/0213; B01F 15/215; B65D 47/08; B65D 47/0804–0852; B65D 75/58–5883; B65D 31/14; B65D 31/142; B65D 31/145
USPC ..... 141/330, 319
See application file for complete search history.

(56) References Cited

U.S. PATENT DOCUMENTS 3,968,872 A * 7/1976 Cavazza ..... B65D 47/18 206/222
4,195,730 A * 4/1980 Hunt ..... B65D 51/2814 206/221
4,371,015 A * 2/1983 Simons ..... G03G 15/087 141/330
4,375,864 A * 3/1983 Savage ..... B65D 77/067 222/81
4,445,551 A * 5/1984 Bond ..... B65D 77/06 141/349
4,614,437 A * 9/1986 Buehler ..... B01F 13/002 141/319
5,041,267 A * 8/1991 Randtke ..... B01L 3/565 422/550
5,533,553 A * 7/1996 Vesborg ..... B65D 1/0223 141/319
5,735,320 A * 4/1998 Tune ..... B65D 81/3211 141/100
6,126,045 A * 10/2000 Last ..... B65D 41/02 222/501
6,871,679 B2 * 3/2005 Last ..... B65D 75/5877 137/614.05
7,635,012 B2 * 12/2009 Johns ..... B65D 51/2814 141/112
8,590,700 B2 * 11/2013 Yang ..... B65D 47/141 206/219
10,661,968 B1 * 5/2020 Hilton ..... A45D 40/24
2002/0092867 A1 7/2002 Last
2006/0144875 A1 * 7/2006 Etesse ..... B05B 11/047 222/494
2011/0011494 A1 * 1/2011 Muhlhausen ..... B65D 47/06 141/331
2012/0216918 A1 * 8/2012 Tsuda ..... B65D 21/086 141/311 R
2013/0319970 A1 * 12/2013 Sugawara ..... B65D 77/003 215/373
2017/0291054 A1 * 10/2017 Compo ..... B65D 31/145
2020/0062464 A1 * 2/2020 Ono ..... B65D 47/08
2020/0095033 A1 * 3/2020 Ono ..... B65D 47/2018

FOREIGN PATENT DOCUMENTS

JP 2011-213397 A 10/2011
JP 2011-213401 A 10/2011
JP 2013-136387 A 7/2013
JP 2013-203464 A 10/2013
JP 2014-129141 A 7/2014

* cited by examiner

POURING SPOUT OF CONTAINER

FIELD OF THE INVENTION

The present invention relates to a pouring spout of a container. More specifically, the present invention relates to a pouring spout of a container used as a refilling container or the like storing contents for refilling a packaging container with the contents.

BACKGROUND ART

Liquid seasoning such as soy sauce and toiletry products such as liquid detergents are, for example, stored in a packaging container made of a resin and consumed. Once a residual amount of the contents is decreased or depleted, the packaging container is refilled with the contents and the product is further used. With such products, a refilling container storing the contents for refilling is prepared separately from the packaging container. As the refilling container, various types have been proposed.

For example, the refilling container proposed in Patent Document 1 is designed to prevent the contents from coming into contact with outside air, in a spout portion. The refilling container described in Patent Document 1 is refilled with contents, allowing repeated use. The repeatedly used packaging container comprises a pouring unit for pouring the contents. The pouring unit is configured by including a pouring nozzle and a peripheral wall provided to a periphery of the pouring nozzle. The refilling container is configured to refill the packaging container with contents by coupling a pouring spout of the refilling container to the pouring unit of the packaging container thus configured.

Specifically, the refilling container described in Patent Document 1 comprises a sealing plate. This sealing plate prevents the contents from being exposed to outside air by closing a position of a pouring opening with a spout of the refilling container. The sealing plate has substantially the same shape as an outer periphery of the pouring nozzle of the packaging container, and is configured by forming a weak line for separating a planned opening part positioned on an inner side of the sealing plate from the sealing plate. According to this refilling container, when the pouring nozzle constituting the pouring unit of the packaging container is inserted into an interior of the pouring spout of the refilling container, the pouring nozzle breaks the sealing plate at the position of the weak line described above, separating the planned opening part, which is a region on the inner side, from the sealing plate. With the sealing plate separated, the refill container is configured to allow transfer of the contents filled in the interior of the refill container to the packaging container to refill the packaging container with the contents.

Patent Documents [0005]

Patent Document 1: Japanese Laid-Open Patent Application No. 2013-203464

SUMMARY OF THE INVENTION

Problems to be Solved by the Invention

Nevertheless, in the refilling container described in Patent Document 1, the planned opening part is formed by forming a weak part in the sealing plate provided to the spout. That is, in the sealing plate, an inner side and an outer side of the weak part is configured by a single member. Thus, when the pouring nozzle is inserted, the sealing part may not allow the planned opening part to smoothly separate at the position of the weak part. When this happens, the pouring nozzle of the packaging container locally breaks through the sealing plate, forming a hole in the sealing plate. When the pouring nozzle of the packaging container locally breaks through the sealing plate, forming a hole in the sealing plate, broken pieces of the sealing plate may be produced. When broken pieces are produced, the broken pieces may enter the packaging container and clog the pouring nozzle of the packaging container.

The present invention is made to resolve the above-described problems, and an object of the present invention is to provide a pouring spout of a container capable of communicating a channel formed in a tubular pouring part of a pouring spout without producing broken pieces or the like.

Means for Solving the Problems

A pouring spout of a container according to the present invention for solving the above-described problems is a pouring spout of a container provided with a spout main body including a tubular pouring part and an attached part attachable to the container on one end side of the tubular pouring part in an axial direction, the pouring spout comprising a closing member for closing the one end side of the tubular pouring part. The closing member is configured as a separate body from the spout main body, and is fitted onto an inner circumferential surface of the tubular pouring part on the one end side thereof in such a manner that the closing member is removed by an external force applied from the other end side opposite to the one end side in the axial direction from the inner circumferential surface of the tubular pouring part.

According to this invention, the closing member that closes the one end side of the tubular pouring part is a separate body from the spout main body, and is fitted onto the inner circumferential surface of the tubular pouring part in such a manner that the closing member is removed by an external force from the inner circumferential surface of the tubular pouring part as described above, and thus the closing member is removed without damage thereto when the closing member is pressed upward by the nozzle constituting the pouring unit of the packaging container to be refilled with contents. Thus, when the closing member is removed from the inner side of the tubular pouring part, broken pieces are not produced. As a result, when the contents are transferred from the container into the packaging container, it is possible refill the packaging container with just the contents. Further, broken pieces are not produced, and thus the pouring unit of the packaging container is never blocked by the broken pieces.

In the pouring spout of a container according to the present invention, the closing member is connected by a coupling member to the spout main body.

According to the present invention, the closing member is connected by the coupling member to the spout main body, making it possible to keep the closing member coupled without separation from the spout main body when the closing member is removed from the inner side of the tubular pouring part. Thus, when the contents are transferred from the container into the packaging container, the closing member is never moved to the packaging container.

In the pouring spout of a container according to the present invention, the closing member, the coupling member, and the spout main body are configured as an integrated object made of a same material.

According to the present invention, the closing member, the coupling member, and the spout main body are configured as an integrated object made of the same material, making it possible to integrally mold these using a manufacturing method such as injection molding. Thus, mass production of pouring spouts having identical quality is possible.

Effect of the Invention

According to the present invention, it is possible to separate a closing member that closes a tubular pouring part of a pouring spout from a spout main body of the pouring spout and communicate a channel formed in the tubular pouring part of the pouring spout without producing broken pieces or the like.

EMBODIMENTS OF THE INVENTION

Figure 1:
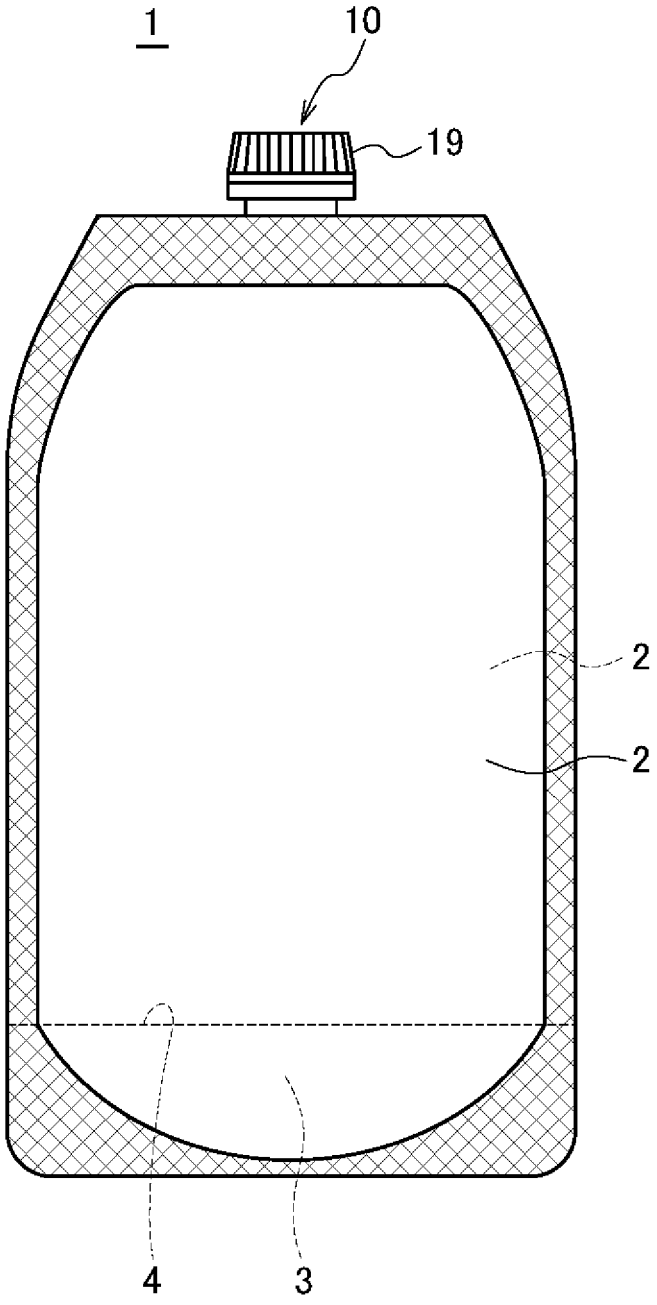
FIG. 1 is a plan view of a standing pouch serving as a refilling container provided with a pouring spout according to the present invention.

An embodiment of the present invention is described below with reference to the drawings. Note that the present invention includes inventions of the same technical idea as the modes set forth in the embodiments and drawings below, and the technical scope of the present invention is not limited to those described in the embodiments and drawings.

[Basic Configuration]

A pouring spout 10 of a container according to the present invention comprises a spout main body including a tubular pouring part 11, and an attached part 15 attachable to the container on one end A side of the tubular pouring part 11 in an axial direction L. This pouring spout 10 comprises a closing member 20 that closes the one end A side of the tubular pouring part 11. The closing member 20 is configured as a separate body from a spout main body 10A. The closing member 20 is fitted onto an inner circumferential surface of the tubular pouring part 11 on the one end A side thereof in such a manner that the closing member 20 is removed by an external force applied from the other end B side opposite to the one end A side in the axial direction L from the inner circumferential surface of the tubular pouring part 11.

The pouring spout 10 of a container according to the present invention exhibits the particular effect of making it possible to separate the closing member 20 serving as a component that closes the tubular pouring part 11 of the pouring spout 10 from the spout main body 10A of the pouring spout 10, and communicate a channel 10*b* formed in the tubular pouring part 11 of the pouring spout 10, without producing broken pieces or the like.

The following describes an overview of a container provided with the pouring spout 10, a specific configuration of the pouring spout 10, an overview of a packaging container 30 used after being refilled with contents stored in the container, and the action of the pouring spout 10. Note that, in the present specification, a mode in which the pouring spout 10 comprises the spout main body 10A, the closing member 20, and a coupling member 21 is described. Further, "packaging container" refers to a container refilled with contents, and "container" refers to a container used as a refilling container or the like storing contents for refilling the packaging container with contents and provided with the pouring spout according to the present invention.

[Container Provided with Pouring Spout]

The container provided with the pouring spout 10 according to the present invention is mainly used as a refilling container for refilling the packaging container 30 used separately from this container with contents. The forms and types of the refilling container are not particularly limited. FIG. 1 shows a standing pouch 1 as an example of a refilling container. This standing pouch 1 comprises a pair of flat surface parts 2 facing each other, a bottom surface part 3 that closes a bottom part of the refilling container, and the pouring spout 10 according to the present invention.

The flat surface parts 2 are sealed together at an upper edge, and sealed together at both side edges. Lower edges of the pair of flat surface parts 2 are each sealed at an edge part of the bottom surface part 3 facing the lower edge of the flat surface part 2. The bottom surface part 3 is folded in half at a crease 4 at a center thereof, and the crease 4 is folded toward an upper side of the standing pouch 1. The bottom surface part 3 is configured to allow a bottom part of the standing pouch 1 to be unfolded by the unfolding of the bottom surface part 3 from the folded state in the directions in which the flat surface parts 2 of the standing pouch 1 are arranged.

The pouring spout 10 according to the present invention is attached to an upper edge of the standing pouch 1. The pouring spout 10 is configured by the spout main body 10A and a cap 19 that freely opens and closes the spout main body 10A. Note that, in the present embodiment, a case where the pouring spout 10 is attached to a middle of an upper part of the standing pouch 1 is given as an example. However, while not particularly illustrated in the drawings, the pouring spout 10 may be provided in a position shifted to a side part in a width direction in the upper part of the standing pouch 1. Further, the standing pouch 1 may be provided with an area communicated by an inclined part where the upper edge and the side edge are obliquely inclined, and the pouring spout 10 may be attached to the inclined part.

The standing pouch 1 is used as a refilling container for transferring the contents into the packaging container 30 (refer to FIG. 4) prepared separately from the standing pouch 1. When the contents are transferred into the packaging container 30, the cap 19 that closes the pouring spout 10 is removed, and the standing pouch 1 is turned upside down. Then, the pouring spout 10 is inserted into a pouring unit 40 of the packaging container 30, and the contents are transferred directly from the standing pouch 1 into the packaging container 30. Note that this action is described in detail later.

[Pouring Spout]

Figure 2:
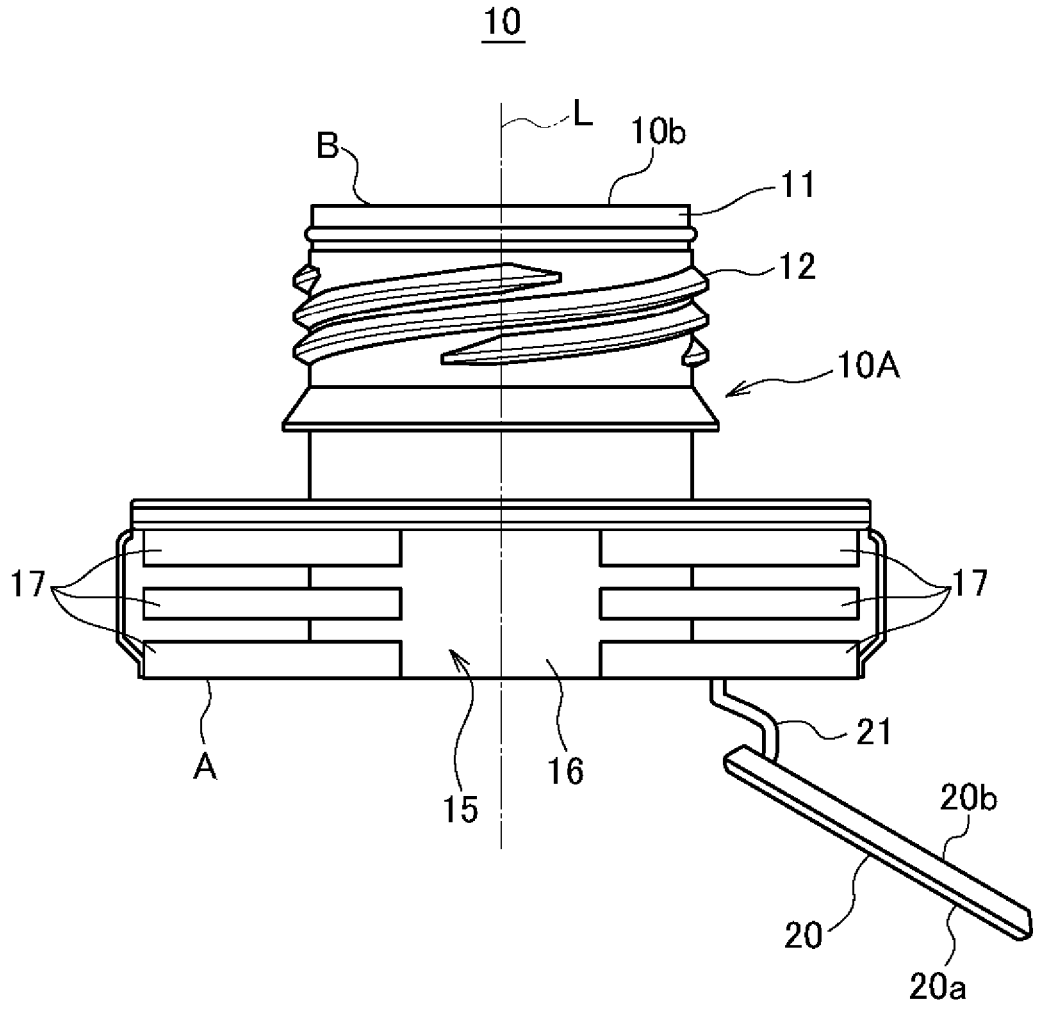
FIG. 2 is a plan view illustrating a front face of the pouring spout of an embodiment according to the present invention.
Figure 3:
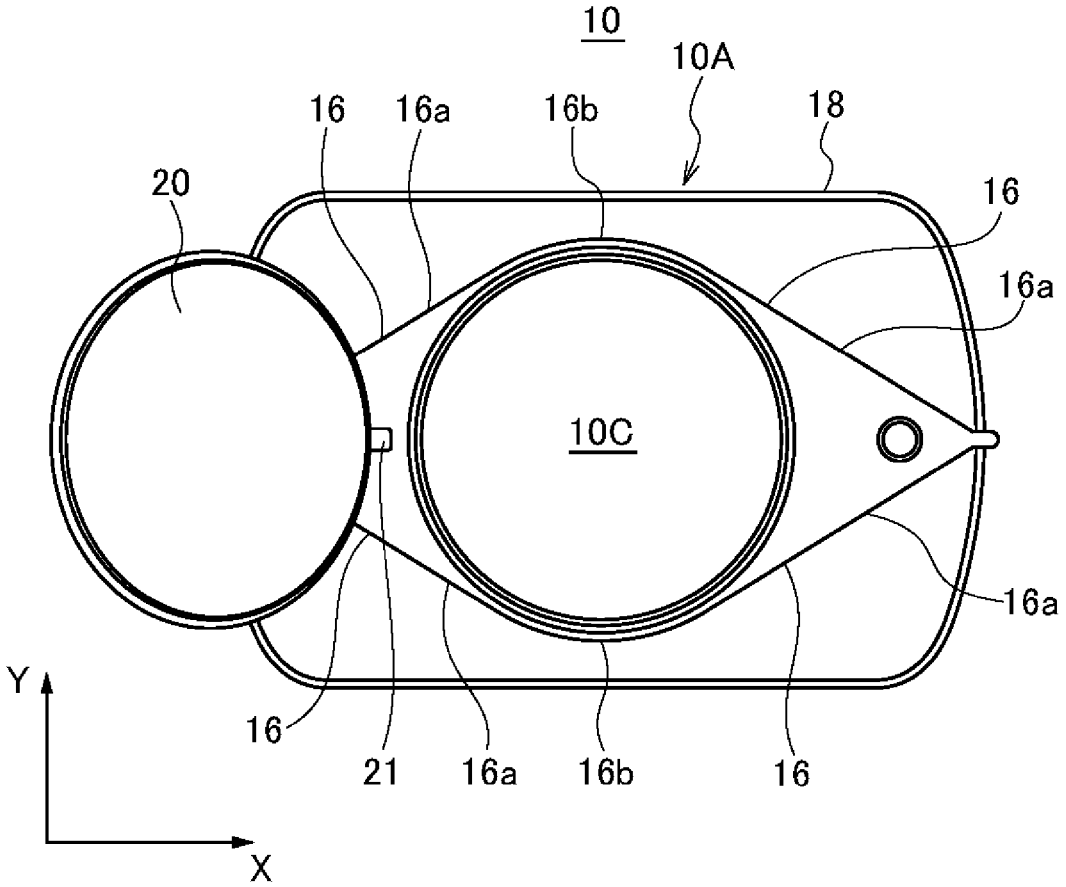
FIG. 3 is a plan view of the pouring spout of the embodiment according to the present invention as viewed from an attached part side.

The pouring spout 10, as illustrated in FIG. 2 and FIG. 3, comprises the tubular pouring part 11 and the attached part 15. The tubular pouring part 11 forms a cylinder. The attached part 15 is an area attached to the standing pouch 1 serving as a container provided with this pouring spout 10, and is provided on the one end A side of the tubular pouring part 11 in the axial direction L. The tubular pouring part 11 is an area used when the contents of the standing pouch 1 provided with the pouring spout 10 are poured from the standing pouch 1. The tubular pouring part 11 has a hollow interior, and both ends in the axial direction L are open in a circular shape. That is, the channel 10*b* is formed in the interior of the tubular pouring part 11. Thus, the tubular pouring part 11 is configured to allow the inner side and the outer side of the standing pouch 1 to communicate.

A thread part 12 is formed on an outer circumferential surface of the tubular pouring part 11. The thread part 12 extends in a circumferential direction, shifts position in the axial direction L, and has a spiral shape. This thread part 12 is an area that engages with a thread part (not illustrated) formed on an inner surface of the cap 19. The tubular pouring part 11 is configured so that, with the thread part of the cap 19 engaged with the thread part 12, the other end B side of the tubular pouring part 11 is closed and opened.

The attached part 15 has a so-called boat shape. A boat shape refers to a shape in which side surface parts 16 of the attached part 15 on both sides in a horizontal direction (direction denoted by reference sign Y in FIG. 3) protrude toward the outer sides, and have acute angles that come to a point on both sides in a vertical direction (direction denoted by reference sign X in FIG. 3). Heights of the side surface parts 16 are uniformly formed.

Each of the side surface parts 16 is configured by an inclined surface part 16*a* that inclines from a center toward the outer side in the Y direction, from both ends in the X direction toward the middle, and a curved part 16*b* that protrudes toward the outer sides in the Y direction in a center portion in the X direction. The curved part 16*b*, as illustrated in FIG. 3, has an arc shape when the pouring spout 10 is viewed from the one end A side. Further, a plurality of protruding parts 17 extending in the vertical direction are formed on each of the side surface parts 16, as illustrated in FIG. 2. A hole 10*c* that passes through this side surface part 16 in a height direction is formed in a center of the attached part 15. This hole 10*c* partially constitutes the channel 10*b* formed in the interior of the tubular pouring part 11.

In this pouring spout 10, a flange 18 protruding toward the outer side in a radial direction is formed in a boundary portion between the tubular pouring part 11 and the attached part 15. This flange 18 is an area extending along the upper edge of the standing pouch 1 when the pouring spout 10 is attached to the upper end of the standing pouch 1.

[Closing Member]

The closing member 20 is a component for closing the channel 10*b* of the pouring spout 10, and is configured as a separate body from the spout main body 10A. This closing member 20 has a disk shape. The closing member 20 closes the channel 10*b* of the pouring spout 10 by being fit onto the inner side of the channel 10*b* of the pouring spout 10 on the one end A side of the tubular pouring part 11 in the axial direction L, that is, on the attached part 15 side. On the other hand, the closing member 20 that closes the channel 10*b* of the pouring spout 10 is configured so that the closing member 20 is removed by an external force applied from the other end B side opposite to the one end A side of the tubular pouring part 11 in the axial direction L from the inner circumferential surface of the tubular pouring part 11. Thus, a diameter of the closing member 20 is formed to the same size as or slightly smaller than an inner diameter of the channel 10*b* of the pouring spout 10.

Note that the channel 10*b* of the pouring spout 10 of the present embodiment has a circular cross-sectional shape, and thus the closing member 20 fitted into the channel 10*b* also has a circular outer shape. However, the outer shape of the closing member 20 is formed into a shape corresponding to the cross-sectional shape of the channel 10*b* of the pouring spout 10. For example, when the channel 10*b* of the pouring spout 10 has an elliptical cross-sectional shape, the outer shape of the closing member 20 is formed into an elliptical shape corresponding to the cross-sectional shape of the channel 10*b* of the pouring spout 10. With the outer shape of the closing member 20 formed into a shape corresponding to the cross-sectional shape of the channel 10*b* of the pouring spout 10, the closing member 20 closes the channel 10*b* without forming a gap between the closing member 20 and the inner circumferential surface of the channel 10*b* of the pouring spout 10 when the closing member 20 is fit onto the inner side of the channel 10*b* of the pouring spout 10.

The closing member 20 is connected to the spout main body 10A by the coupling member 21. The coupling member 21 in the example illustrated in FIG. 2 and FIG. 3 is made of a resin, and has a long, narrow string shape. This coupling member 21 can be formed into a strip shape as well, for example. That is, the closing member 20 is connected by the coupling member 21 having a string shape or a strip shape to the spout main body 10A. One end of the coupling member 21 in the longitudinal direction is coupled to an end surface of the spout main body 10A on the one end A side. Specifically, one end of the coupling member 21 in the longitudinal direction is coupled to a lower end surface of the attached part 15. This one end is coupled to the lower end surface of the attached part 15 at a position slightly shifted to the outer side in a radial direction from the peripheral part of the channel 10*b*. In contrast, the other end of the coupling member 21 in the longitudinal direction is coupled to a lower surface 20*b* of the closing member 20. That is, the coupling member 21 couples the lower surface 20*b* of the closing member 20, which is a surface facing the lower side in a mode of being fitted into the channel 10*b*, and the attached part 15.

Note that an upper surface 20*a* of the closing member 20 is a surface facing the upper side in a mode in which the closing member 20 is fitted into the channel 10*b* of the pouring spout 10. That is, the upper surface 20*a* of the closing member 20 is a surface facing the other end B side of the tubular pouring part 11 in the axial direction L in a mode in which the closing member 20 is fitted into the channel 10*b* of the pouring spout 10. In contrast, the lower surface 20*b* of the closing member 20 is a surface facing the lower side in a mode in which the closing member 20 is fitted into the channel 10*b* of the pouring spout 10. That is, the lower surface of the closing member 20 is a surface facing the interior of the container (standing pouch 1) to which the pouring spout 10 is attached in a mode in which the closing member 20 is fitted into the channel 10*b* of the pouring spout 10. The coupling member 21 couples the closing member 20 and the spout main body 10A in such a manner that a force is applied in a direction in which the closing member 20 is separated from the channel 10*b* of the pouring spout 10.

Both ends of the coupling member 21 couple the spout main body 10A and the closing member 20 as described above, and thus the closing member 20 is fitted onto the inner side of the channel 10*b* without the coupling member 21 getting pinched between the closing member 20 and the channel 10*b*. Further, when the closing member 20 is removed from the inner side of the channel 10*b*, the closing member 20 is maintained in a state of connection to the pouring spout 10 without being separated from the spout main body 10A. The coupling member 21 couples the closing member 20 and the spout main body 10A in such a manner that a force is applied in a direction in which the closing member 20 is separated from the channel 10*b* of the pouring spout 10, and thus the closing member 20 removed from the channel 10*b* is kept from blocking the channel 10*b* once again. As a result, it is possible to smoothly transfer contents from the standing pouch 1 into the packaging container 30.

The pouring spout 10 described above is molded using a resin such as polyethylene, polypropylene, polyester, ethylene-vinyl copolymer, and polyvinyl chloride. However, the material of the pouring spout 10 is not limited as long as the pouring spout is moldable. Further, examples of applicable raw materials of the resin include petroleum-derived materials, plant-derived materials, copolymers thereof, and blend resins thereof

[Packaging Container]

Figure 4:
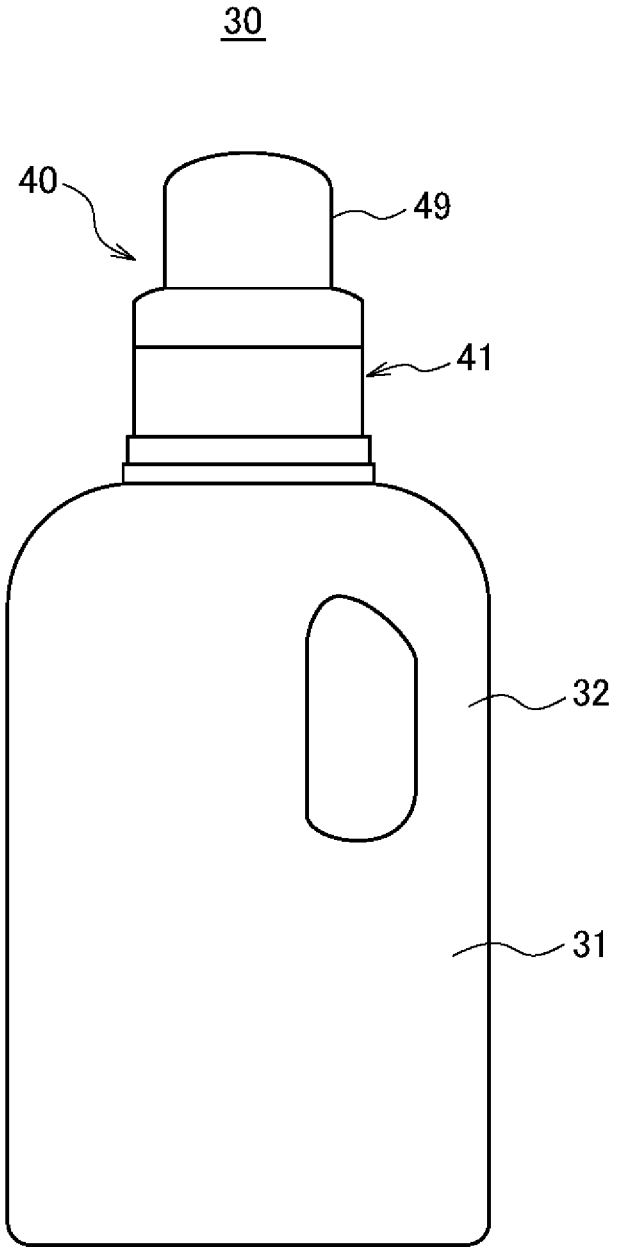
FIG. 4 is a plan view of a packaging container to be refilled with contents from the standing pouch serving as the refilling container.

The packaging container 30 is a container used after being refilled with contents stored in the standing pouch 1. The packaging container 30 is made of a resin or the like, for example. FIG. 4 shows an example of the packaging container 30. The packaging container 30 illustrated in FIG. 4 is configured by a container main body 31 provided with a handle 32, and the pouring unit 40 for pouring the contents stored in the container main body 31. This packaging container 30 is used by removing from the packaging container 30 the contents moved from the standing pouch 1 in an amount required when necessary.

Figure 5:
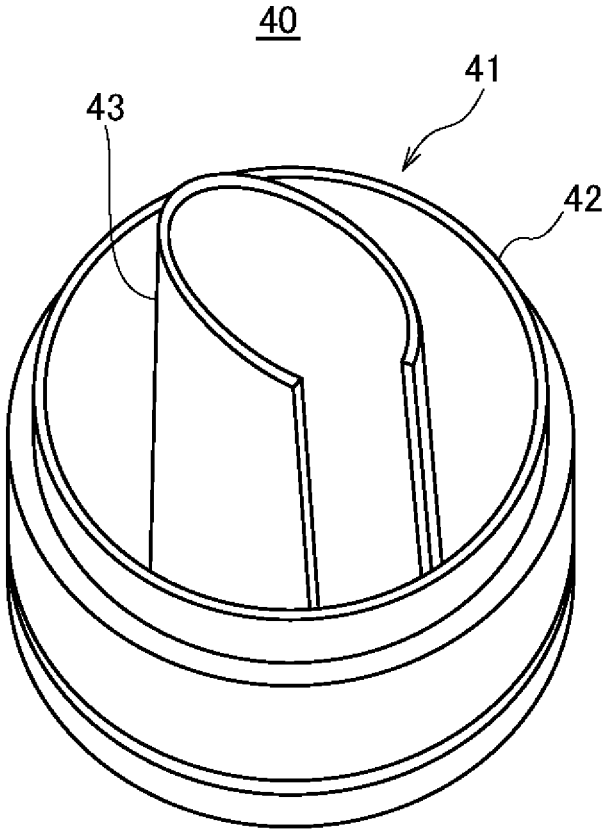
FIG. 5 is a perspective view of a pouring unit constituting the packaging container illustrated in FIG. 4.

The pouring unit 40 of the packaging container 30 is configured by a main body part 41, and a cap 49 for opening and closing the main body part 41. The main body part 41, as illustrated in FIG. 5, comprises a peripheral wall surface 42, and a nozzle 43 disposed on an inner side of this peripheral wall surface 42. The peripheral wall surface 42 has a cylinder shape. The inner side of the peripheral wall surface 42 is hollow.

The nozzle 43 is disposed in a middle or substantial middle position of the main body part 41. The nozzle 43 is connected to the peripheral wall surface 42, and is integrated with the peripheral wall surface 42. The nozzle 43 is configured to protrude toward an upper side of the main body part 41, with a tip end thereof positioned on an upper side of the upper end of the peripheral wall surface 42. FIG. 5 shows one example of the shape of the nozzle 43, and the shape of the nozzle 43 is not particularly limited.

[Manufacturing Method of Pouring Spout]

The pouring spout 10 can be manufactured by various manufacturing methods. However, when manufacturing efficiency, manufacturing cost, and quality are considered, the spout main body 10A, the closing member 20, and the coupling member 21 are preferably integrally molded by injection-molding a resin. The manufacturing method for injection-molding a resin allows the spout main body 10A, the closing member 20, and the coupling member 21 to be integrally molded using the same material, making it possible to increase the manufacturing efficiency and keep the manufacturing cost to a low level. Further, once a die is manufactured, products having the identical quality can be repeatedly manufactured.

[Procedure for Refilling Packaging Container with Contents and Action of Pouring Spout]

The procedure for refilling the packaging container 30 with the contents stored in the standing pouch 1, and the action of the pouring spout 10 of the present embodiment will now be described with reference to FIG. 6. Note that, to make the action of the pouring spout 10 easy to understand, the standing pouch 1 and the container main body 31 of the packaging container 30 are not illustrated in FIG. 6. However, the pouring spout 10 is attached to the standing pouch 1, which is a refilling container, illustrated in FIG. 1, and the pouring unit 40 is provided to the packaging container 30 illustrated in FIG. 4.

Figure 6A:
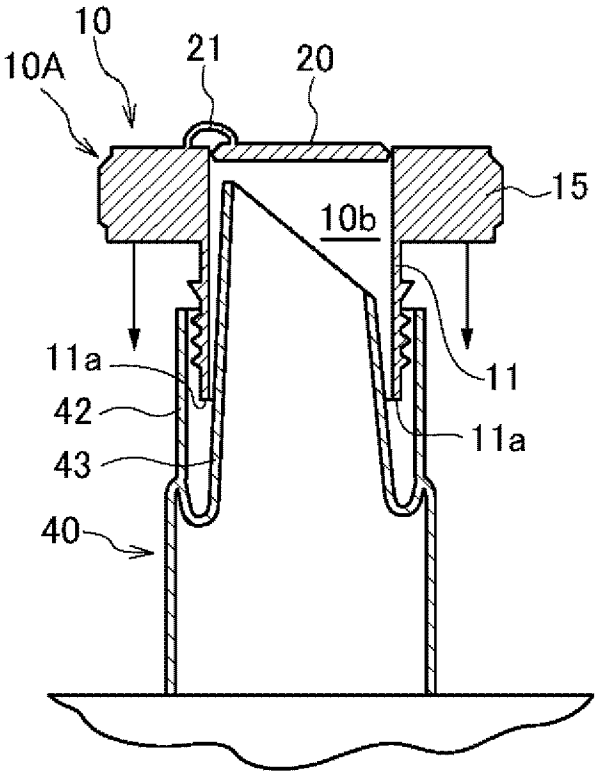
FIG. 6A and FIG. 6B are explanatory views for explaining an action of the pouring spout according to the present invention.

First, the cap 19 is removed from the pouring spout 10, the standing pouch 1 is turned upside down, and the pouring spout 10 is positioned on a lower side of the standing pouch 1. The channel 10*b* of the pouring spout 10 is closed by the closing member 20, and thus the contents stored in the standing pouch 1 never spill out. Next, as illustrated in FIG. 6A, the pouring spout 10 is matched with the position of the pouring unit 40 of the packaging container 30 from which the cap 19 is removed, and the nozzle 43 of the pouring unit 40 is inserted into the channel 10*b* of the pouring spout 10. That is, the nozzle 43 of the pouring unit 40 is inserted into the channel 10*b* configured on the inner side of the tubular pouring part 11 constituting the pouring spout 10.

Figure 6B:
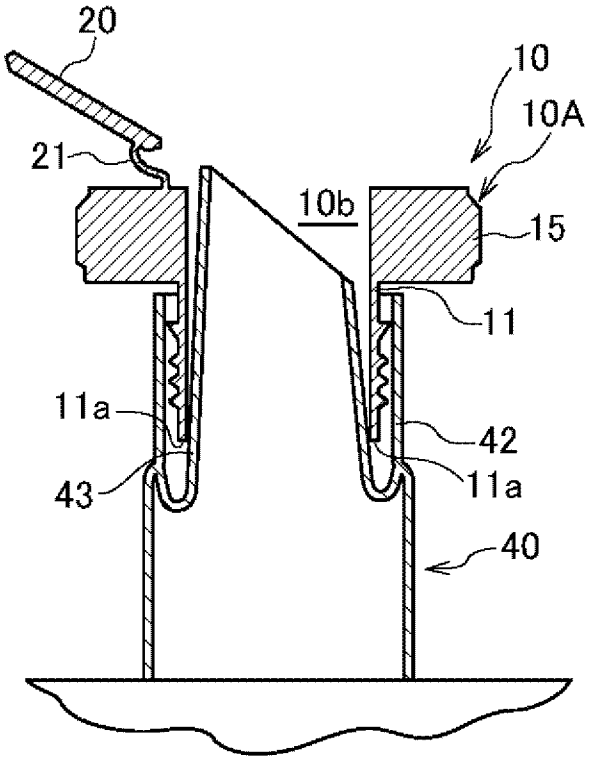

Next, with the nozzle 43 inserted into the tubular pouring part 11, the pouring spout 10 is pressed further downward on the pouring unit 40 side. When the pouring spout 10 is pressed downward, the tip end of the nozzle 43 presses the closing member 20 upward. Thus, as illustrated in FIG. 6B, the closing member 20 is removed from the channel 10*b* constituting the inner side of the tubular pouring part 11. That is, the closing member 20 is removed by an external force applied from the other end B side (tip end side of the cylindrical pouring part) opposite to the one end A side (end part side provided with the attached part 15) of the tubular pouring part in the axial direction L from the inner circumferential surface of the tubular pouring part 11. The closing member 20, in a mode of removal from the inner circumferential surface, is fitted horizontally onto an inner circumferential surface of the tubular pouring part 11 on the one end A side thereof. At this time, the closing member 20 is configured as a separate body from the spout main body 10A, and is fitted into the channel 10*b* constituting the tubular pouring part 11, simply closing the channel 10*b*, and thus is smoothly removed from the channel 10*b* without causing the closing member 20 itself to be damage by the nozzle 43. As a result, simply the contents are moved into the packaging container 30 without producing broken pieces.

Further, as illustrated in FIG. 6B, the nozzle 43 is inserted into the interior of the tubular pouring part 11 and, when the closing member 20 is removed from the spout main body 10A, a tip end part 11*a* of the tubular pouring part 11 comes into contact with an outer circumferential surface of the nozzle. That is, in a mode in which the nozzle 43 is inserted into the tubular pouring part 11, the tip end of the tubular pouring part 11 is formed to a size resulting in contact with the outer circumferential surface of a base portion of the nozzle 43. Thus, the contents poured from the refill container 1 (standing pouch) are moved to the packaging container 30 through the nozzle 43 without leaking to the outer side of the nozzle 43.

With regard to this point, in conventional products, the component for closing the channel and a pouring spout were integrally configured. When a component for closing was to be opened, a portion having a thin thickness was formed around the component for closing, and then the portion having a thin thickness was cut when the nozzle 43 pressed the component for closing upward. However, according to the configuration of the related art, even when the component for closing was pressed upward by the nozzle 43, the portion formed with a thin thickness might not be fully cut, making formation of the channel incomplete. Further, when the component for closing was fully cut from the thinned portion by the nozzle 43, a defect might occur in which the component for closing was moved along with the contents to the packaging container 30.

According to the pouring spout 10 of the present embodiment as described above, when the pouring spout 10 is attached to the standing pouch 1 serving as a refilling container, the channel 10*b* formed in the interior of the tubular pouring part 11 constituting the pouring spout 10 is closed, making it possible to prevent the contents from coming into contact with outside air. Further, it is possible to separate the component that closes the tubular pouring part 11 of the pouring spout 10 from the pouring spout 10 and communicate the channel 10*b* formed in the tubular pouring part 11 of the pouring spout 10 without producing broken pieces or the like.

DESCRIPTIONS OF REFERENCE NUMERALS

1 Refill container (Standing pouch)
2 Flat surface part
3 Bottom surface part
4 Crease
10 Pouring spout
10A Spout main body
10*b* Channel
10*c* Hole
11 Tubular pouring part
11*a* Tip end part
12 Thread part
15 Attached part
16 Side surface part
16*a* Inclined surface part
16*b* Curved part
17 Protruding part
18 Flange
19 Cap
20 Closing member
20*a* Upper surface
20*b* Lower surface
21 Coupling member
30 Packaging container
31 Container main body
32 Handle
40 Pouring unit
41 Main body part
42 Peripheral wall surface
43 Nozzle
A One end in axial direction
B Other end in axial direction
L Extending direction of tubular pouring part

What is claimed is:

1. A pouring spout, consisting of:

a spout main body which comprises a tubular pouring part and an attached part attachable to a container on one end side of the tubular pouring part in an axial direction of the tubular pouring part; and a closing member connected to the spout main body via a coupling member, the closing member being positioned to close the one end side of the tubular pouring part and fitted onto an inner circumferential surface of the tubular pouring part on the one end side thereof such that the closing member is removable from the inner circumferential surface of the tubular pouring part by an external force applied from an other end side opposite to the one end side in the axial direction, wherein one longitudinal end of the coupling member is connected to the attached part of the spout main body, and the coupling member is a string or a strip made of a resin.

2. The pouring spout according to claim 1, wherein the closing member, the coupling member, and the spout main body are an integrated object made of a same material.

3. The pouring spout according to claim 2, wherein the integrated object is made by injection-molding the same material.

4. The pouring spout according to claim 3, wherein the coupling member connects the closing member and the attached part of the spout main body such that the coupling member imparts a force in a direction in which the closing member is separated from a channel of the tubular pouring part.

5. The pouring spout according to claim 2, wherein the same material is the resin.

6. The pouring spout according to claim 2, wherein the coupling member connects the closing member and the attached part of the spout main body such that the coupling member imparts a force in a direction in which the closing member is separated from a channel of the tubular pouring part.

7. The pouring spout according to claim 1, wherein the coupling member has an other longitudinal end opposite to the one longitudinal end, and the other longitudinal end is connected to a lower end surface of the closing member, which is a lower surface of the closing member in a state where the closing member is fitted into the inner circumferential surface of the tubular pouring part positioned above the attached part.

8. The pouring spout according to claim 1, wherein the closing member is fitted to the inner circumferential surface of the tubular pouring part on the one end side thereof such that the closing member is perpendicular to the axial direction of the tubular pouring part.

9. The pouring spout according to claim 1, wherein the tubular pouring part is configured to contain contents to be transferred into a packaging container which comprises a pouring spout having a nozzle and a channel for passing the contents, and a tip end part of the tubular pouring part is formed such that the nozzle is capable of being inserted in the tubular pouring part and that when the nozzle is inserted in the tubular pouring part, the tip end part of the tubular pouring part contacts an outer circumferential surface of a base portion of the nozzle.

10. The pouring spout according to claim 1, wherein the coupling member connects the closing member and the attached part of the spout main body such that the coupling member imparts a force in a direction in which the closing member is separated from a channel of the tubular pouring part.

11. The pouring spout according to claim 1, wherein the coupling member is a string made of a resin.

12. The pouring spout according to claim 1, wherein the coupling member is a strip made of a resin.

13. The pouring spout according to claim 1, wherein the resin comprises at least one selected from the group consisting of polyethylene, polypropylene, polyester, ethylene-vinyl copolymer, and polyvinyl chloride.

14. A refill container, comprising:

a refill container body; and the pouring spout of claim 1 attached to the refill container body.

15. A method of filling a container, comprising:

inserting a nozzle of a pouring spout of the container into the tubular pouring part of the refill container of claim 14;

removing the closing member from the inner circumferential surface of the tubular pouring part by a force applied from the nozzle without breaking the closing member; and transferring contents of the refill container to the container.

16. A pouring spout, consisting of:

a spout main body which comprises a tubular pouring part and an attached part attachable to a container on one end side of the tubular pouring part in an axial direction of the tubular pouring part;

a closing member connected to the spout main body via a coupling member, the closing member being positioned to close the one end side of the tubular pouring part and fitted onto an inner circumferential surface of the tubular pouring part on the one end side thereof such that the closing member is removable from the inner circumferential surface of the tubular pouring part by an external force applied from an other end side opposite to the one end side in the axial direction; and a cap that removably closes the other end side of the tubular pouring part, wherein one longitudinal end of the coupling member is connected to the attached part of the spout main body, and the coupling member is a string or a strip made of a resin.

17. The pouring spout according to claim 16, wherein a thread part is formed on an outer circumferential surface of the tubular pouring part of the spout main body, and the thread part engages with a thread part formed on an inner surface of the cap.

18. A refill container, comprising:

a refill container body; and the pouring spout of claim 16 attached to the refill container body.

19. The refill container according to claim 18, further comprising:

contents contained in the refill container body.

* * * * *